US005794275A

United States Patent [19]

Donzis

[11] Patent Number: 5,794,275

[45] Date of Patent: Aug. 18, 1998

[54] IMPACT ABSORBING SHIELD FOR PROTECTIVE GEAR

[76] Inventor: Byron A. Donzis, #18 W. Rivercrest, Houston, Tex. 77042

[21] Appl. No.: 599,290

[22] Filed: Feb. 9, 1996

[51] Int. Cl.[6] ..... A41D 13/00; A41D 13/08

[52] U.S. Cl. ..... 2/455; 2/16; 2/20; 2/24; 2/425

[58] Field of Search ..... 2/16, 2, 20, 24, 2/425, 161.1, 160, 455

[56] References Cited

U.S. PATENT DOCUMENTS

| | | | |
|---|---|---|---|
| 4,012,794 | 3/1977 | Nomiyama | 2/411 |
| 4,564,959 | 1/1986 | Zahn | 4/411 |
| 5,373,584 | 12/1994 | Parcells, III | 2/2 |
| 5,459,878 | 10/1995 | Gold | 2/23 |
| 5,553,330 | 9/1996 | Carveth | 2/425 |

FOREIGN PATENT DOCUMENTS

| | | | |
|---|---|---|---|
| 961431 | 3/1957 | Germany | 2/16 |
| 965 | of 1888 | United Kingdom | 2/16 |
| 2233877 | 1/1991 | United Kingdom | 2/16 |

*Primary Examiner*—Bibhu Mohanty

[57] ABSTRACT

An improved street sport impact absorbing shield including ball bearings positioned along the outer surface of the shield for providing a rolling impact surface upon a fall to translate a tangential moment of impact. The recesses include sockets or channels for retaining the ball bearings along the outer surface and allowing rotary motion in every direction upon impact.

17 Claims, 2 Drawing Sheets

FIG. 1
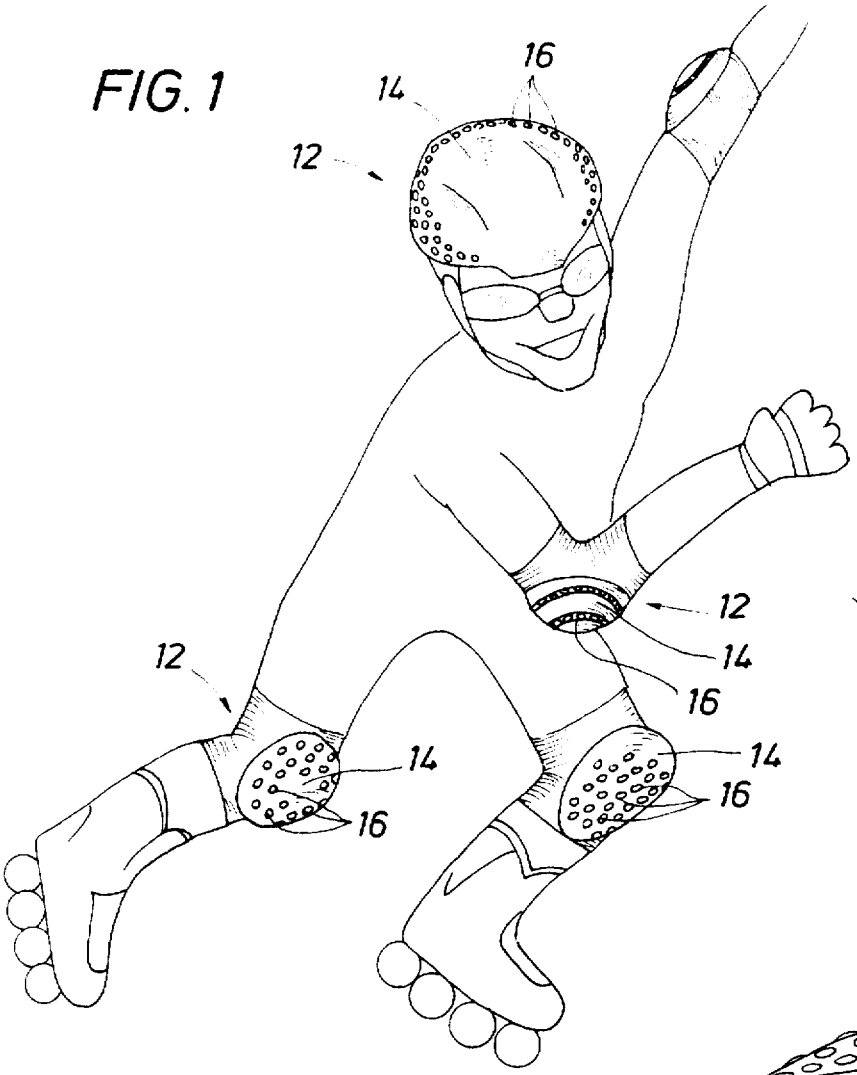
FIG. 3
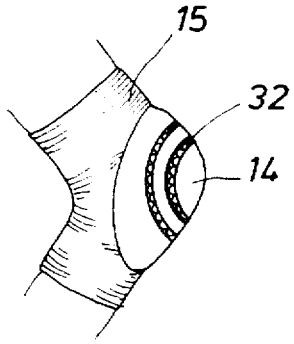
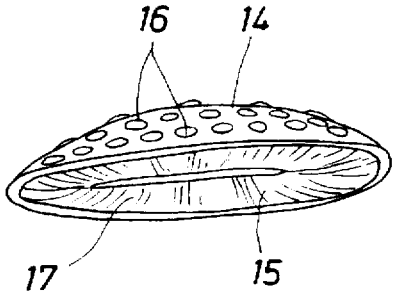
FIG. 1A
FIG. 2
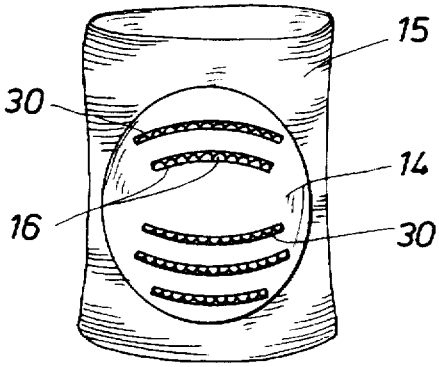
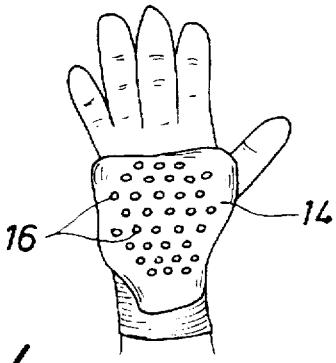
FIG. 4

IMPACT ABSORBING SHIELD FOR PROTECTIVE GEAR

BACKGROUND OF INVENTION

1. Field of Invention

The subject invention is generally related to impact absorbing equipment and is specifically directed to an improved impact absorbing pad for street sport protective gear.

2. Description of the Prior Art

With the increasing popularity of street sports, such as biking and in-line roller skating and street hockey, the number of accidents and injuries to participants has steadily increased. Health officials, in particular roller buffs, and the multi-million dollar street sport industry are growing concerned at the rising number of contusions, sprains and fractures suffered by participants. The thrill and the problem with such sports is that they can obtain speeds up to 30 m.p.h. and greater over concrete and asphalt, which speed may be difficult to control and stop, particularly for beginners.

Because street sports are conducted on hard surfaces, such as concrete, asphalt and other pavements, a fall is more likely to result in injury for two reasons. On the one hand, the street comprises an unforgiving surface. One the other hand, in a fall, the horizontal component of motion occasions high frictional contact. Impact has a tangential moment almost as significant as a vertical component. Although protective gear is presumed, the effect of the tangential moment on the gear can cause the gear to shear away and result in significant injuries to the underlying body.

Therefore, there is a need for an improved protective gear for street sport participants, such as bikers and in-line roller skaters, that will disperse the impact of a fall, absorb any tangential moment of impact without shifting and more fully protect the participant from being injured.

SUMMARY OF THE INVENTION

The instant invention is directed to an improved street sport impact absorbing pad including a shield having a plurality of bearings strategically positioned along the shield surface. The bearings provide a rolling contact point upon a fall to absorb without shearing and translate tangential moments of impact. Specifically, the subject invention is directed to protective gear worn by street sport participants, such as bikers, street hockey players and in-line roller skaters. Typical gear comprises knee pads, elbow pads, wrist guards and helmets. The invention may apply to protective gear for any sport in which a participant may fall on hard concrete or asphalt surfaces. Upon a fall to the pavement, impact from the vertical component of motion is absorbed by the padding system. The participant's horizontal component of motion, however, results in a lateral high friction contact with the gear. The addition of bearings along the surface of the impact absorbing padding can translate the tangential moment of impact into a force that rotates the bearings and permits the gear to absorb the horizontal component without shifting on the body, thereby continuing to provide protection from injuries caused by the sudden horizontal halt.

In a preferred embodiment, the improved impact absorbing pad includes a shield having a plurality of recesses on the outer surface for holding bearings and/or associated bearing races.

Typically, ball bearings are loose hardened spheres, usually steel, that roll easily in a race. Any rigid, loose spherical or rounded object that is contained in and rolls easily in a socket in at least one, and preferably every direction, may be utilized. For example, a plurality of hard plastic or rubber spheres may be used. Preferably, the bearings of the subject invention not only easily rotate within the recesses but partially extend from the recesses above the surface of the shield to absorb initial contact with the pavement upon the impact of a fall.

The plurality of recesses should be strategically positioned along an outer surface of the shield to first absorb the predictable tangential moments of impact. In a preferred embodiment, each of the plurality of recesses may define a socket shaped to retain a bearing while allowing rotary motion. Each socket would preferably comprise a self-lubricating plastic, such as by way of example, but not limited to, teflon, polyethylene or urethane, for providing a non-stick surface to enhance the retained ball bearing rotating freely within the socket to provide a rolling impact surface.

In an alternative embodiment, the outer shield surface may include a plurality of recesses or openings. Separate sockets or cups, retaining bearings, may be placed into or under and secured around each recess or opening. Again, the bearing would freely rotate within the socket and partially extend above the shield surface to provide a rolling impact surface. The socket may be positioned in or under the recess or opening to protrude beyond the surface of the shield or may be flush with the surface. The socket may be secured in the recess by attaching the bottom of the socket to the recess, such as by way of example, gluing the socket to the recess. Alternatively, the socket may include a flanged top end for holding the socket under an opening.

In an alternative embodiment, a recess or opening along a surface of the shield may define an elongated channel or trough adapted to hold and expose a plurality of ball bearings within the channel or trough to provide a rolling surface to translate a tangential moment of impact. The channel is shaped to rotatably secure the plurality of loose bearings along an outer surface of the shield and preferably includes a self-lubricating plastic for providing a non-stick surface.

Therefore, it is an object and feature of the subject invention to provide an improved street sport impact absorbing pad for providing increased protection from injuries caused by a fall on pavement.

It is an additional object and feature of the subject invention to provide an improved impact absorbing pad including a plurality of bearings along an outer surface of the shield to translate tangential moments of impact upon a fall.

Other objects and features will be readily apparent from the accompanying drawings and description.

BRIEF DESCRIPTION OF THE DRAWINGS

FIG. 1 is a perspective view of an improved street sport impact absorbing pad as applied to protective gear for in-line roller skating, including a plurality of bearings positioned along a surface of the shield.

FIG. 1A illustrates a cushion attached to a shield in an alternate embodiment.

FIG. 2 is a perspective view of a knee pad showing a plurality of ball bearings positioned in elongated channels located along an outer surface of the impact absorbing shield.

FIG. 3 is a perspective view of an elbow pad showing a standard ring bearing positioned in the outer surface of the impact absorbing shield.

FIG. 4 is a perspective view of a wrist guard including a plurality of recesses defining sockets for holding bearings.

DETAILED DESCRIPTION OF THE DRAWINGS

Figure 5:
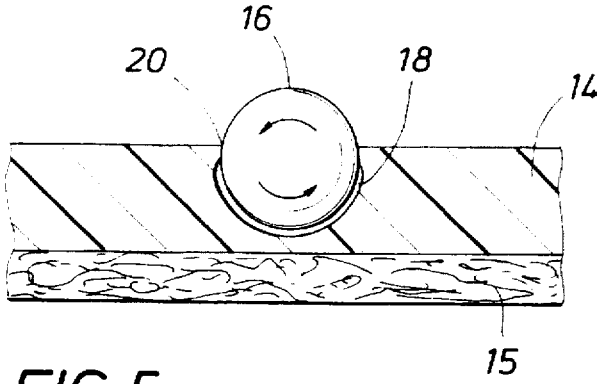
FIG. 5 is an enlarged cross-sectional view of a recess in the shield surface overlying an impact absorbing cushion, the recess defining a socket shaped to rotatably secure a ball bearing.

Referring to FIGS. 1–4, the improved street sport impact absorbing shield is designated generally by the reference numeral 12 and comprises an impact absorbing shell or shield 14 and a plurality of ball bearings 16 along the outer surface of the shield. As shown, the subject invention is specifically directed to protective gear worn by in-line roller skaters, such as helmets, wrist guards, elbow pads and knee pads, for providing a rolling surface upon a fall to translate a tangential moment of impact. Typically, the protective gear includes the shield 14 overlying an impact absorbing cushion 15 with Lycra or similar-type stretch 17 fabric next to the skin.

In the preferred embodiment, the improved impact absorbing shield 14 includes a plurality of recesses 18 on the outer surface of the shield for holding the ball bearings 16. In each of the embodiments of the subject invention, the ball bearings 16 are easily rotatable and partially extend from the recesses above the shield surface to provide a rolling impact surface. The ball bearings 16 are typical ball bearings of hardened steel which are multi-directional and roll in every direction, as are well known. However, any rigid, loose spherical object, such as a hard plastic or rubber sphere, that rolls easily in every direction may be utilized. As shown in FIGS. 1–4, the recesses 18 are strategically positioned along the outer surface of the shield so that the ball bearings 16 first encounter the pavement upon a fall to translate a tangential moment of impact into a rolling motion for providing increased protection from injuries caused by a fall on pavement.

Figure 6:
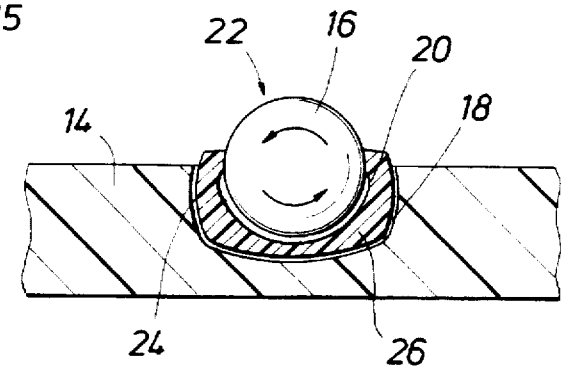
FIG. 6 is an enlarged cross-sectional view of a ball bearing in a socket positioned in and attached to a recess in the shield.
Figure 7:
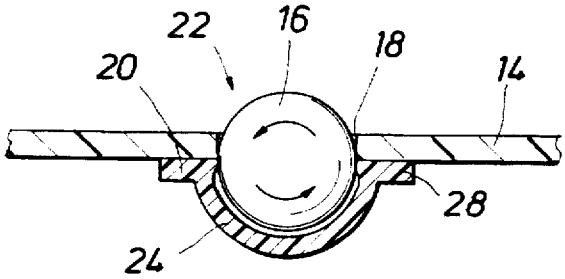
FIG. 7 is an enlarged cross-sectional view of a ball bearing in a socket which includes a flanged top end for holding the socket adjacent an opening in the shield.

In the preferred embodiment, each recess 18 in the shield surface defines a socket 20 shaped to retain a ball bearing while allowing rotary motion in every direction. Thus, the recesses are formed along the surface of the shield so that the recesses themselves are the sockets for rotatably retaining the ball bearings. In an alternative embodiment, the socket 20 is a separate element attached to the recess 18 and containing a ball bearing 16. As shown in FIGS. 5–7, the socket 20 in both embodiments extends minimally past the diameter of the ball bearing 16 and is shaped so that the ball bearing 16 is retained but freely rotates within the socket. Also, the sockets 20 include a self-lubricating plastic, such as teflon, polyethylene or urethane, for providing a non-stick surface so that the ball bearings freely rotate to provide a rolling impact surface.

In the alternative embodiment shown in FIGS. 6 and 7, the socket 20 is a separate element including an open top end 22, closed sides 24 and a closed bottom end 26. The ball-and-socket combination is placed in the recess and the bottom end 26 of the socket is glued or otherwise attached to the surface of the shield inside the recess (see FIG. 6). Alternatively, the sides 24 may include a flanged edge 28 at the top end 22 of the socket which holds the socket in the recess 18 (see FIG. 7).

Figure 8:
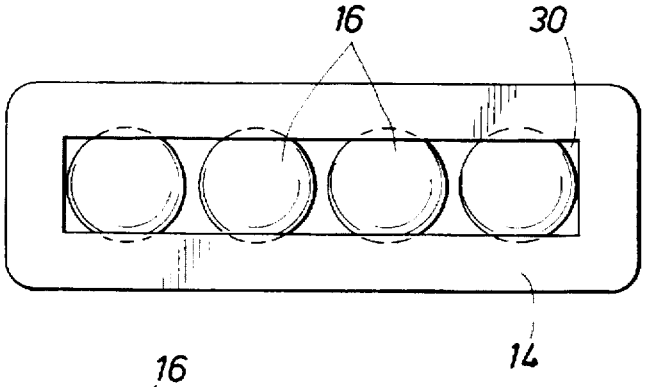
FIG. 8 is an enlarged overhead view of a channel in a surface of a shield including a plurality of ball bearings in the channel.
Figure 9:
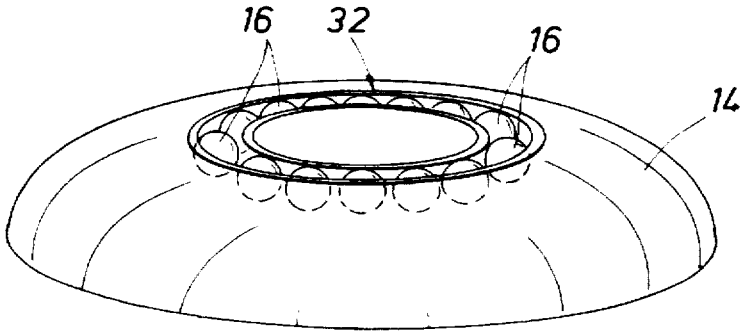
FIG. 9 is an enlarged cross-sectional view of a standard ring bearing positioned under an opening in an impact absorbing shield of an elbow pad.

In another embodiment shown in FIGS. 8 and 9, the recesses 18 along the outer shield surface define channels 30. Each elongated channel 30 holds a plurality of ball bearings which partially extend above the surface of the shield and rotate freely to translate a tangential moment of impact into a rolling motion. The channel 30 is shaped to rotatably secure the plurality of loose ball bearings along the outer surface of the shield and includes a self-lubricating plastic for providing a non-stick surface. As shown in FIG. 9, the channel 30 may be circular and encompass bearings retained by a circular cage 32. This may be particularly useful in cap-shaped shields, such as by way of example, the shield portion of an elbow pad.

While specific embodiments and features of the invention have been disclosed herein, it will be readily understood that the invention encompasses all enhancements and modifications within the scope and spirit of the following claims.

What is claimed is:

1. An improvement in a street sport impact absorbing pad adapted to be worn on a body and having a shield with an outer surface, said improvement comprising:

a plurality of multi-directional bearings positioned so as to encompass an area of the outer shield surface and exposed to the environment to provide a rolling contact point with a non-attached, impact imparting surface to translate a tangential moment of impact.

2. The improvement in the impact absorbing pad of claim 1 wherein said shield surface includes a plurality of recesses for retaining said bearings and wherein said bearings are rotatable with respect to, and partially extend from, said recesses.

3. The improvement in the impact absorbing pad of claim 2 wherein a recess defines a socket shaped to rotatably secure a bearing.

4. The improvement in the impact absorbing pad of claim 3 wherein said socket "is comprised of" a self-lubricating material for providing a non-stick surface.

5. The improvement in the impact absorbing pad of claim 1 wherein said shield surface includes a recess defining a channel shaped to rotatably secure a plurality of bearings.

6. The improvement in the impact absorbing pad of claim 5, wherein said channel comprises a self-lubricating material for providing a non-stick surface whereby said bearings freely rotate in said channel.

7. The improvement in the impact absorbing pad of claim 2 further including a socket secured in a recess, said socket adapted to retain a bearing.

8. The improvement in the impact absorbing pad of claim 7 wherein said socket further includes an open top end, closed sides and a closed bottom end, said bottom end being attached to said recess.

9. The improvement in the impact absorbing pad of claim 1, wherein said shield surface includes an opening and a socket having an open top end, closed slides and a closed bottom end, said top end including a flanged edge for securing said socket to said shield around said opening to secure within a bearing.

10. The improvement in the impact absorbing pad of claim 7, wherein said socket comprises a self-lubricating plastic.

11. The improvement in the impact absorbing pad of claim 7, wherein the top end of the socket is positioned to be even with the surface of the shield.

12. The improvement in the impact absorbing pad of claim 8, wherein the top end of the socket is positioned to protrude beyond the surface of the shield.

13. The pad of claim 1 including a cushion layer attached to a lower surface of said shield.

14. The pad of claim 13 wherein said cushion layer is covered with a stretch fabric.

15. A method for absorbing impact from a fall by a person traversing a hard surface, comprising:

attaching to a human extremity a pad including a shield portion; and attaching a plurality of bearings on an area of said shield portion, said bearings being exposed to the environment and free to rotate multi-directionally with respect to said shield surface and being located to encompass an area of said shield surface likely to contact said hard surface upon a fall by the person traversing said hard surface.

16. An improvement in a street sport impact absorbing pad adapted to be worn on the arms, hands or legs of a body and having a shield with an outer surface exposed to the environment and material adapted to attach the shield to the extremity, said improvement comprising:

a plurality of multi-directional bearings positioned to encompass an area of the outer exposed shield surface to provide a rolling contact point with a non-attached, impact imparting surface.

17. An improvement in a street sport impact absorbing pad adapted to be worn on a body and having a shield with an outer surface, said improvement comprising:

means for providing a multi-directional rolling contact bearing with a non-attached, impact imparting surface to translate a tangential moment of impact against said absorbing pad.

* * * * *